US007004820B1

(12) United States Patent
Teng et al.

(10) Patent No.: US 7,004,820 B1
(45) Date of Patent: Feb. 28, 2006

(54) CMP METHOD AND DEVICE CAPABLE OF AVOIDING SLURRY RESIDUES

(75) Inventors: Ching-Wen Teng, Tao-Yuan Hsien (TW); Ming-Hsing Kao, Tai-Tung Hsien (TW); Chin-Kun Lin, Kao-Hsiung (TW); Er-Yang Chua, Singapore (SG); Lee-Lee Lau, Melaka (MY)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 10/908,814

(22) Filed: May 26, 2005

(51) Int. Cl.
*B24B 29/00* (2006.01)

(52) U.S. Cl. ..... 451/41; 451/54

(58) Field of Classification Search ..... 451/41, 451/57, 56, 60, 287, 444, 54; 15/97.1; 134/902
See application file for complete search history.

(56) References Cited

U.S. PATENT DOCUMENTS

| | | | | |
|---|---|---|---|---|
| 5,861,066 | A * | 1/1999 | Moinpour et al. | 134/6 |
| 6,206,760 | B1 * | 3/2001 | Chang et al. | 451/41 |
| 6,319,105 | B1 * | 11/2001 | Togawa et al. | 451/287 |
| 2002/0063169 | A1 * | 5/2002 | Verhaverbeke et al. | 239/436 |
| 2002/0187731 | A1 * | 12/2002 | Chen et al. | 451/36 |
| 2004/0132318 | A1 * | 7/2004 | Kim et al. | 438/906 |

* cited by examiner

*Primary Examiner*—Jacob K. Ackun, Jr.
(74) *Attorney, Agent, or Firm*—Winston Hsu

(57) ABSTRACT

A method for chemical mechanical polishing (CMP) includes a rinsing process performed to clean an orifice of a slurry supplier and other elements of a CMP device. The CMP device includes least one nozzle disposed in the periphery of a base. The function of the nozzle is to spray DI water to the orifice of the slurry supplier so as to prevent slurry residue and clogging.

5 Claims, 1 Drawing Sheet

CMP METHOD AND DEVICE CAPABLE OF AVOIDING SLURRY RESIDUES

BACKGROUND OF INVENTION

1. Field of the Invention

The invention relates to a chemical mechanical polishing (CMP) device, and more particularly, to a CMP device comprising at least one nozzle arranged around a base of the CMP device, so as to spray DI water to at least one orifice of a slurry supplier, and thereby prevent the orifice from being clogged.

2. Description of the Prior Art

Elements of wafers are becoming smaller and more integrated, and the requirement for improvement in the depth of focus of lithography is growing. As a result, in very large-scale integration (VLSI) and ultra large-scale integration (ULSI), a plurality of layers of metal interconnects and low K dielectric materials are widely adopted to connect elements of a semiconductor wafer, so as to form high-density circuits. However, these elements result in severe topography of the semiconductor wafer, and thus make a deposition or pattern transfer process become difficult. Therefore, a planarization process has to be performed on the wafer surface before further processing.

Conventional planarization mostly counts on spin in glass (SOG) and resist etch back (REB) processes. However, in processes with a feature size smaller than 25 $\mu$m, global planarization can not be reached by using SOG or REB. Therefore, a chemical mechanical polishing (CMP) which can be applied in small feature size processes is adopted in VLSI and ULSI for planarization. Generally, if all parameters are appropriate, planarity can reach up to 94%.

In a CMP process, slurry is provided on a surface subjected to planarization, and a mechanical polishing process is performed on the surface. A conventional CMP device includes a polishing pad, a movable wafer carrier above the polishing pad, and a supplier that supplies slurry and DI water. In the conventional CMP process, the wafer carrier holds a wafer and offers the wafer to the surface of the polishing pad to make them contact. Then, the supplier supplies slurry to the polishing pad through orifices, while the wafer and the polishing pad are in contact and rubbing against each other.

The CMP slurry includes chemical agents and abrasives. The chemical agents can be pH buffers, oxidants, surfactants or the like, and the abrasives can be silica, alumina, zirconium oxide, or the like. The chemical reactions evoked by the chemical agents and the abrasion between the wafer and the polishing pad can planarize the surface of the wafer.

However, slurry and pieces that have come off the wafer during polishing can be left on the device elements thereby contaminating the wafer. For example, particles left can lead to breakdown of oxides, and pieces of polysilicon and metals may cause electric leakage and therefore may decrease the yield and reliability of the wafer. As a result, after the CMP process, a cleaning process needs to be performed to prevent such contamination. The conventional cleaning methods include a wet cleaning process using a chemical basin, a megasonic (ultrasonic, supersonic, or finesonic) cleaning process, and a cleaning process using a brush scrubber. These cleaning processes are able to remove contaminants from the wafer, so as to prevent defects formed on the wafer.

However, such cleaning methods are not able to remove contaminants on the device elements, such as slurry supplier and the polishing head, effectively. For example, the orifices of the slurry supplier may be clogged with crystals of the slurry. In addition, if the crystals fall on the wafer, scratches may be formed on the wafer. Therefore, an effective method needs to be provided to solve this problem.

SUMMARY OF INVENTION

Therefore, it is the primary object of the claimed invention to provide a CMP method to remove contaminants on the device elements.

In addition, it is another object of the claimed invention to provide a CMP device to perform the method.

According to the present invention, a CMP device is provided. The CMP device comprises a base having a central region and a peripheral region. In the central region, a platen is disposed, and a polishing pad is disposed on the platen. While in the peripheral region, at least one nozzle is set. The CMP device further comprises a supplier disposed above the polishing pad, and the supplier has at least an orifice to spray DI water to the polishing pad.

A polishing process is provided. In the polishing process, a wafer carrier is used to hold a wafer, and to allow the wafer to contact the polishing pad. Following that, a rinsing process is performed. In the rinsing process, the supplier sprays DI water through the orifice to the polishing pad, while the nozzle sprays DI water to the orifice of the supplier simultaneously, so as to prevent the orifice from being clogged.

The CMP method and device according to the present invention are able to clean slurry or other contaminants remaining on the orifices of the slurry supplier and other device elements, so as to prevent remaining material from scratching the wafer in a subsequent process.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
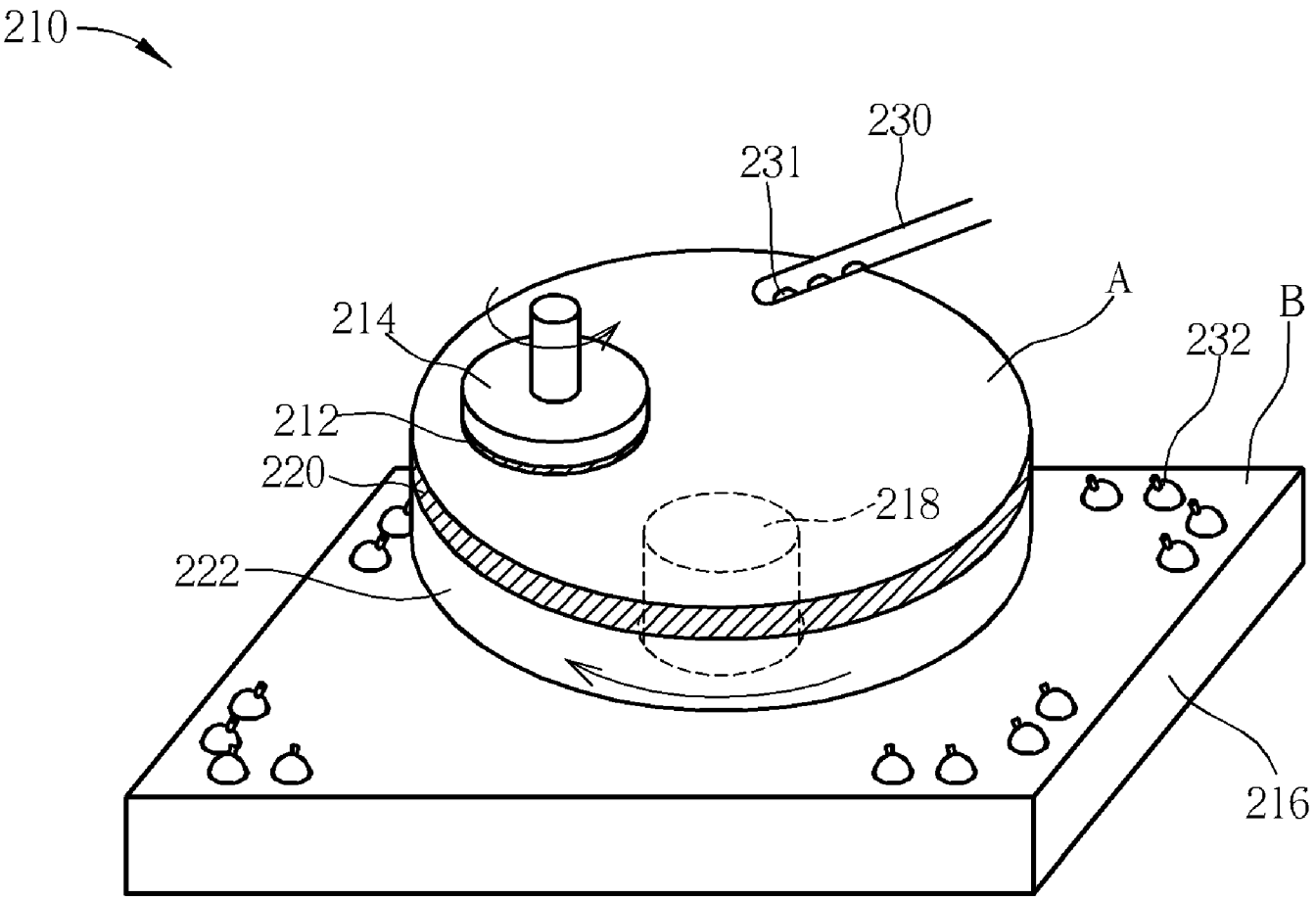
FIG. 1 illustrates a CMP device according to the present invention.

Compared to conventional chemical mechanical polishing (CMP) methods and devices, the CMP method and device according to the present invention provide a rinsing process that can clean a slurry supplier and other device elements, so as to prevent contaminants left on the device elements from affecting the quality of a subsequent CMP process.

Please refer to FIG. 1. FIG. 1 is a perspective diagram illustrating the preferred embodiment according to the present invention. As shown in FIG. 1, a CMP device 210 according to the present invention includes a base 216, and a platen 222 disposed above the base 216. By the edge of the platen 222, the base 216 is divided into two regions: central region A and peripheral region B. In the central region A, a polishing pad 220 is disposed above the platen 222. A plurality of nozzles 232 are set on the peripheral region B for spraying DI water. The angles that the nozzles 232 make with respect to the plane of the base 216 are adjustable. A wafer carrier 214, which can hold and spin a wafer 212, is disposed above the polishing pad 220. In addition, a supplier 230 that can supply slurry and DI water is also set above the polishing pad 220. The supplier 230 includes an internal slurry line (not shown) and an internal DI water line (not shown), and at least one orifice 231 for spraying slurry and DI water according to requirements.

In addition, a spindle 218 connects the center of the platen 222 to a motor (not shown) in the base, so as to drive and spin the platen 222 and the polishing pad 220. For example, the motor can drive the spindle 218 so as to spin the platen 222 clockwise, and the wafer carrier 214 can hold the wafer 212 and spin it counterclockwise.

In a preferred embodiment according to the present invention, the wafer carrier 214 holds the wafer 212 such that the wafer 212 contacts the surface of the polishing pad 220. Then, the supplier 230 supplies slurry, such as silicon suspended in potassium hydroxide, via the orifices 231 to the polishing pad 220, while the wafer 212 and the polishing pad 220 are relatively moving against each other.

After the polishing process is finished, a rinsing process is performed. In the rinsing process, the supplier 230 supplies DI water to the wafer 212, and the nozzles 232 spray DI water to the orifices 231 of the supplier 230. The nozzles 232 can be adjusted to appropriate angles. In addition, the DI water line (not shown) of the supplier 230 connects to the same source as a DI water line (not shown) of the nozzles 232. As a result, the supplier 230 and the nozzles 232 are able to spray DI water at the same time.

In another embodiment of the present invention, the angles of the nozzles 232 are fixed. However, the nozzles 232 are able to spray water to the orifices 231 at these fixed angles.

Compared to the prior art, the nozzles 232 are provided in the CMP device 210 according to the present invention. The nozzles 232 are able to clean the slurry supplier 230 and the orifice(s) 231 thereon in one rinsing process. Therefore, any remained crystals of the slurry can be removed without additional cleaning steps. The quality of a subsequent process is thus maintained. In addition, the nozzles 232 are set in surplus space, i.e. the peripheral region B, of the device 210, and thus do not cause a change in the arrangement of the device. Therefore ease of installation and use are other advantages of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for chemical mechanical polishing (CMP), comprising:

providing a CMP device comprising a base having a central region and a peripheral region, wherein a platen is disposed in the central region, a polishing pad is disposed on the platen, and at least one nozzle is set on the peripheral region; the CMP device further comprising a supplier set above the polishing pad, wherein the supplier has at least an orifice to spray DI water onto the polishing pad;

performing a polishing process, wherein a wafer carrier holds a wafer to allow the wafer to contact the polishing pad; and following that, performing a rinsing process, the supplier spraying DI water through the orifice to the polishing pad, and the nozzle spraying DI water to the orifice of the supplier simultaneously, so as to prevent the orifice from being clogged.

2. The method of claim 1, wherein the platen comprises a central spindle that is connected to the base and is driven by a motor in the base, so as to rotate the platen and the polishing pad.

3. The method of claim 1, wherein the supplier comprises a slurry line, and a first DI water line connected to a DI water supplier.

4. The method of claim 3, wherein the nozzle comprises a second DI water line connected to the DI water supplier.

5. The method of claim 1, wherein the angle of the nozzle is adjustable.

* * * * *